US005467927A

United States Patent [19]

Lee

[11] Patent Number: 5,467,927

[45] Date of Patent: Nov. 21, 1995

[54] SHOWER HEAD WITH SELECTIVELY USABLE VIBRATING AND PULSATING ELEMENT

[75] Inventor: Man H. Lee, Shatin, Hong Kong

[73] Assignee: Brand New Technology Limited, Kowloon, Hong Kong

[21] Appl. No.: 308,935

[22] Filed: Sep. 20, 1994

[30] Foreign Application Priority Data

Sep. 21, 1993 [GB] United Kingdom ..... 9319480

[51] Int. Cl.[6] ..... B05B 3/04; A61H 23/04

[52] U.S. Cl. ..... 239/383; 239/447; 239/449

[58] Field of Search ..... 239/443–449, 239/381, 383

[56] References Cited

U.S. PATENT DOCUMENTS 5,070,864 12/1991 Lemons ..... 601/160

FOREIGN PATENT DOCUMENTS 1038489 9/1958 Germany ..... 239/449
1574734 9/1980 United Kingdom .
2068778 8/1981 United Kingdom ..... 239/381

*Primary Examiner*—Karen B. Merritt
*Attorney, Agent, or Firm*—Leydig, Voit & Mayer

[57] ABSTRACT

A shower head which comprises a body which has a forward chamber and a tubular rear end through which water is arranged to be supplied to the chamber for exit from the chamber through a front side thereof. The shower head includes a vibration generator provided within the chamber for generating vibration of the shower head. The vibration generator is adapted to be driven by water flowing through the chamber. The shower head further includes a switch adapted to enable and/or disable the operation of the vibration generator, the switch being provided at the front side of the forward chamber of the body.

11 Claims, 2 Drawing Sheets

SHOWER HEAD WITH SELECTIVELY USABLE VIBRATING AND PULSATING ELEMENT

The present invention relates to a shower head.

SUMMARY OF THE INVENTION

According to the invention, there is provided a shower head which comprises:

a body which has a forward chamber, said chamber having a front side, and a tubular rear end through which water is arranged to be supplied to the chamber for exit from the chamber through the front side;

a vibration generator provided within the chamber for generating vibration of the shower head, said vibration generator being adapted to be driven by water flowing through the chamber; and a switch adapted to enable and/or disable the operation of the vibration generator, said switch being provided at the front side of the forward chamber of the body.

Preferably, the switch is associated with the front side of the chamber such that depression of the front side relative to the chamber will enable the operation of the vibration generator.

It is advantageous for the switch to be self-resetting.

Conveniently, the switch is self-resetting and the front side of the chamber is resiliently biassed outwards.

In a preferred embodiment, the switch is arranged to switch the water flow within the chamber between first and second paths before exiting the chamber, said vibration generator being provided in the first but not the second water flow path.

More preferably, the switch comprises two valves which are provided in the first and second water flow paths, respectively, and are associated to have generally complementary open and closed conditions.

Even more preferably, the two valves are operable by a single operating member.

It is preferred that the switch is associated with the front side of the chamber such that depression of the front side relative to the chamber will enable the operation of the vibration generator, and the valve operating member is mechanically coupled with the front side of the chamber.

In a specific construction, the valve operating member is tubular for water to pass therethrough in one of the two water flow paths.

Preferably, the vibration generator is provided by a turbine which has a centre of gravity off its axis of rotation.

More preferably, the turbine carries or incorporates an eccentric weight.

In a preferred construction, the turbine includes a blade which is arranged, when the turbine rotates, to momentarily intercept the associated water flow path, thereby providing a pulsating showering effect.

The invention will now be more particularly described, by way of example only, with reference to the accompanying drawings.

DETAILED DESCRIPTION OF PREFERRED EMBODIMENT

Figure 1:
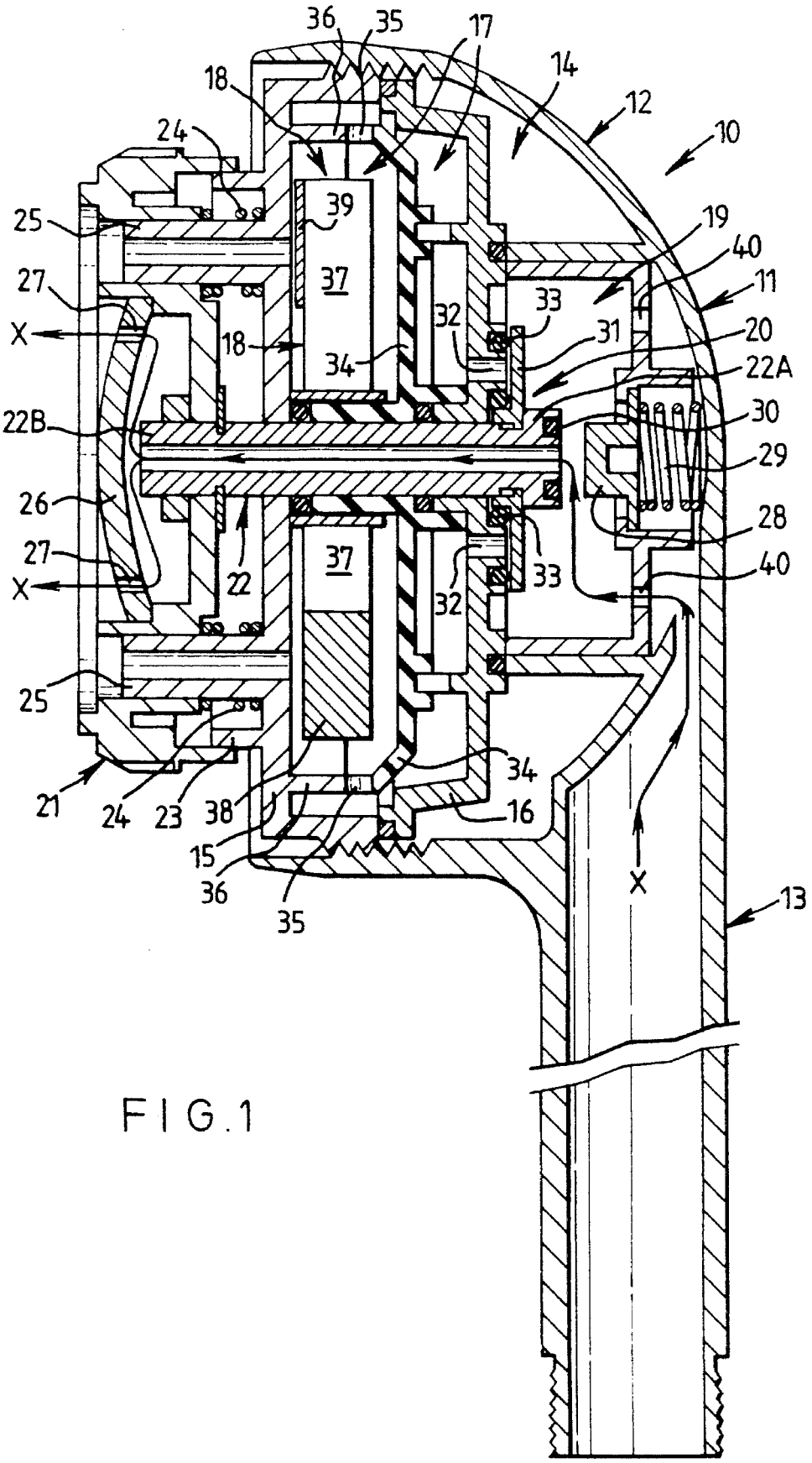
FIG. 1 is a cross-sectional side view of an embodiment of a shower head in accordance with the invention.

Referring to the drawings, there is shown a shower head 10 embodying the invention, being in a normal operating condition. The shower head 10 comprises a moulded plastic body 11 which has an enlarged hollow forward end 12 and a tubular rear end 13. The forward end 12 provides therein a generally hemispherical chamber 14 which is closed on its planar front side by a circular cap-like cover 15 facing inwards and engaged therein through peripheral screw-thread engagement. The chamber 14 is divided by a circular partition 16 into a front compartment 17 for accommodating a turbine 18 and a rear compartment 19 for accommodating a valve 20.

The shower head 10 further includes an external cap-like circular spray bracket 21 which is provided co-axially on the outer side of the front cover 15, and a tubular valve operating shaft 22 co-axially passing through at its innermost end 22A the partition 16, on its way the front cover 15, and at its outermost end 22B the bracket 21. The spray bracket 21 is slidably disposed on and around a front-extending integral collar 23 on the front cover 15, and is mounted fast on the outermost end 22B of the valve operating shaft 22. The innermost end 22A of the valve operating shaft 22 is enlarged to engage behind the partition 16.

The spray bracket 21 is resiliently biassed outwards by four compression coil springs 24 which are disposed on respective integral tubular posts 25. The posts 25 extend outwards from the front cover 15 and pass through the spray bracket 21. More such posts 25 may be provided, whether with or without said coil springs 24 thereon. Under the action of the springs 24 via the spray bracket 21, the valve operating shaft 22 is also resiliently biassed outwards into a rest position (FIG. 1). The outermost end 22B of the valve operating shaft 22 is concealed within the spray bracket 21 by a circular cover plate 26 fixed on the front side of the spray bracket 21. The cover plate 26 has a ring of holes 27.

Reference is now made to the valve 20. The innermost end 22A of the valve operating shaft 22 enters into the front side of the valve compartment 19 through the centre of the partition 16. At the centre of the opposite (rear) side of the valve compartment 19, there is provided an abutment 28 which is directly confronting the valve operating shaft end 22A and is resiliently biassed towards that end 22A by a compression coil spring 29. The valve operating shaft end 22A is fitted with a rubber O-ring 30 such that it can be sealingly closed by being pressed against the abutment 28 when the valve operating shaft 22 is pushed inwards from the rest position (FIG. 1) into a pushed-in position (FIG. 2).

The valve operating shaft 22 carries a centrally apertured valve operating disc 31, immediately behind its enlarged innermost end 22A. Directly underneath the disc 31, the partition 16 has four holes 32. Each hole 32 is surrounded by a respective O-ring 33 so as to enable the disc 31 to sealingly close the holes 32 when the disc 31 is pressed there-against with the valve operating shaft 22 in the rest position (FIG. 1).

Figure 2:
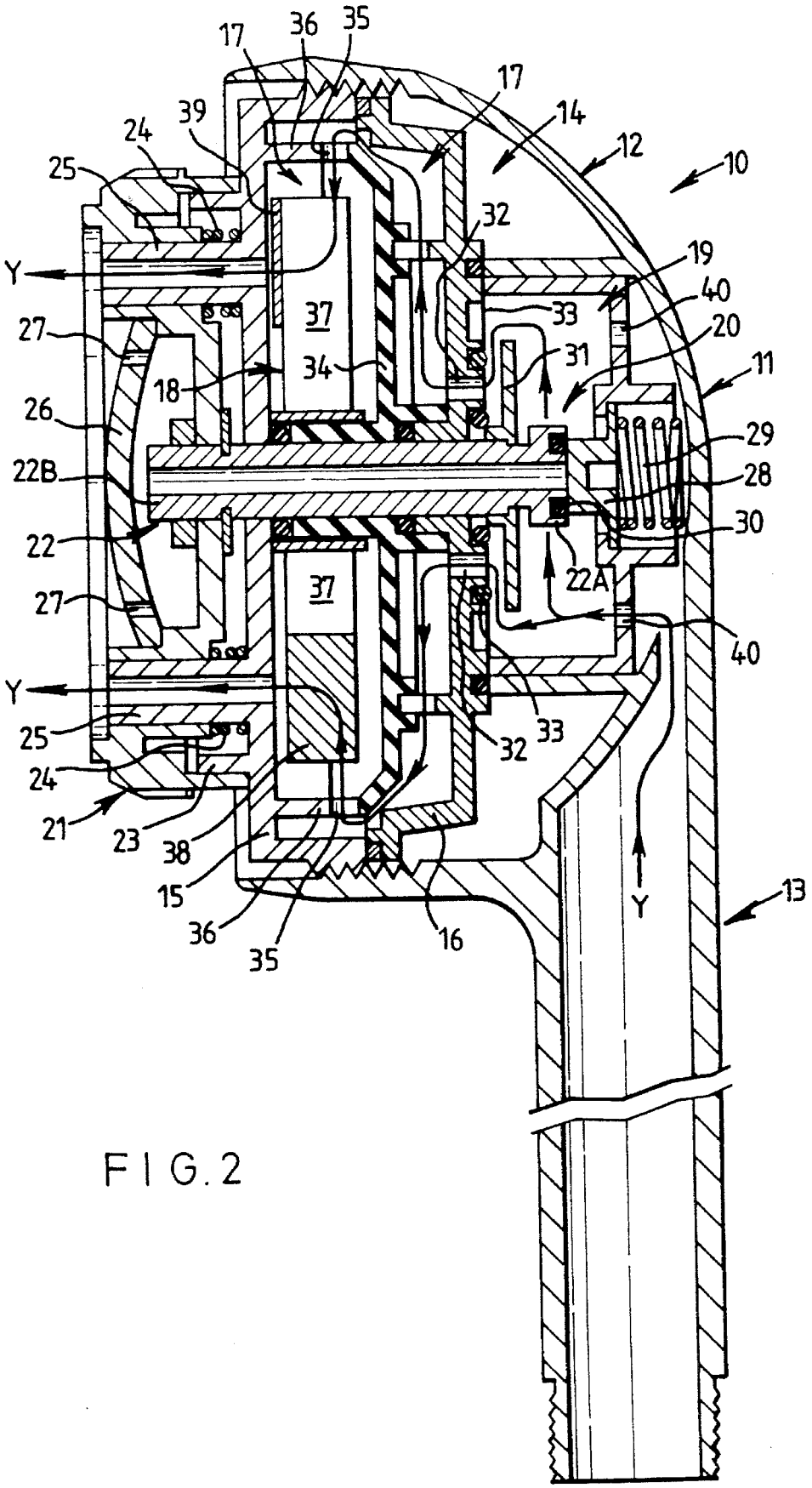
FIG. 2 is a cross-sectional side view of the shower head of FIG. 1, in a different operating condition.

Comparing FIGS. 1 and 2, it is clear that in the rest position of the valve operating shaft 22, the interior of the valve compartment 19 communicates with that of the valve operating shaft 22 but not that of the turbine compartment 17, as shown in FIG. 1. On the other hand, when the valve operating shaft 22 is in the pushed-in position, the interior of the valve compartment 19 communicates with instead that of the turbine compartment 17 but no longer that of the valve operating shaft 22.

Inside the turbine compartment 17, the turbine 18 is rotatably supported about the valve operating shaft 22. A circular plate deflector 34 is disposed around the shaft 22 behind the turbine 18 such that the holes 32 cannot communicate with the turbine 18 directly through the deflector 34 but round the deflector 34 through holes 35 formed in an internal peripheral wall 36 of the turbine compartment 17. The turbine 18 has a plurality of equi-angularly spaced blades 37, on one of which blades 37 an eccentric weight 38 is mounted whereas the diametrically opposite blade 37 has a front flange 39 slightly off the front cover 15.

In use, water is supplied into the shower head 10 through the rear end 13 to reach the forward chamber 14 where water firstly enters the valve compartment 19 via rear holes 40.

For normal showering operation, the valve operating shaft 22 is in the rest position as shown in FIG. 1. The water flows from the valve compartment 19 into the shaft 22 via the shaft innermost end 22A and subsequently leaves the shaft 22 at the shaft outermost end 22B and hits the cover plate 26 and finally exits as spray through the holes 27 of the cover plate 26. This water flow path is illustrated by line X in FIG. 1.

As shown in FIG. 2, when the shower head 10 is pressed by a user with its spray bracket 21 against the user's body, the spray bracket 21 is moved inwards relative to the shower head body 11, whereby the valve operating shaft 22 is pushed-in. When the valve operating shaft 22 is in the pushed-in position, the water from the valve compartment 19 flows via the holes 32 into the turbine compartment 17 instead of the shaft 22 whose innermost end 22A is now closed by the abutment 28. Inside the turbine compartment 17, the water flows round the deflector 34 and hits the turbine 18 at its blades 37, thereby driving the turbine 18. The water finally leaves the turbine compartment 17 and exits through the tubular posts 25 as spray. This water flow path is illustrated by line Y in FIG. 2.

The turbine 18 will vibrate when it rotates, under the action of the eccentric weight 38, thereby providing a massaging effect. When the turbine 18 rotates, its flange 39 will momentarily block the tubular posts 25 in turn, thereby intercepting the water flow and thus providing a pulsating spray effect.

In this shower head 10, the spray bracket 21 operates as a self-resetting mechanical switch for switching the water flow between the path X by-passing the turbine 18 and the path Y via the turbine 18. This water flow switching function may be performed instead by a self-resetting press-button provided on the spray bracket which is then fixed rather than movable.

It is envisaged that the spray bracket 21 may be arranged to have two stable operating positions such that the massaging vibration may be turned on and off at any time irrespective of whether the shower head is pressed against the user's body. A separate manual switch may be provided, for example, on the back of the shower head to control the water flow path and hence the massaging vibration, in place of the spray bracket 21.

The invention has been given by way of example only, and various modifications of and/or alterations to the described embodiment may be made by persons skilled in the art without departing from the scope of the invention as specified in the appended claims.

What is claimed is:

1. A shower head comprising:

a body which has a forward chamber, the chamber having a front side, and a tubular rear end through which water is supplied to the forward chamber for exit from the forward chamber through the front side;

a vibration generator provided within the forward chamber for generating vibration of the shower head, the vibration generator being driven by water flowing through the chamber; and a switch for enabling and disabling operation of the vibration generator, the switch being located at the front side of the forward chamber of the body, and wherein the switch is associated with the front side of the forward chamber so that depression of the front side relative to the forward chamber enables operation of the vibration generator.

2. The shower head as claimed in claim 1, wherein the switch is self-resetting.

3. The shower head as claimed in claim 1, wherein the switch is self-resetting, and the front side of the forward chamber is resiliently biased outwards.

4. The shower head as claimed in claim 1, wherein the switch switches water flow within the forward chamber between first and second paths before exiting the forward chamber, the vibration generator being located in the first but not the second path.

5. The shower head as claimed in claim 4, wherein the switch comprises two valves located in the first and second paths, respectively, and generally have generally complementary open and closed conditions.

6. The shower head as claimed in claim 5, wherein the two valves are operable by a single valve operating member.

7. The shower head as claimed in claim 6, wherein the switch is associated with the front side of the forward chamber such that depression of the front side of the forward chamber enables operation of the vibration generator, and the single operating member is mechanically coupled with the front side of the chamber.

8. The shower head as claimed in claim 6, wherein the single valve operating member is tubular for water to flow in one of the two paths.

9. The shower head as claimed in claim 1, wherein the vibration generator includes a turbine which has a centre of gravity off an axis of rotation.

10. The shower head as claimed in claim 9, wherein the turbine incorporates an eccentric weight.

11. The shower head as claimed in claim 9, wherein the turbine includes a blade which momentarily intercepts an associated water flow, thereby providing a pulsating showering effect.

* * * * *